US007137914B1

(12) United States Patent
Boyer et al.

(10) Patent No.: US 7,137,914 B1
(45) Date of Patent: Nov. 21, 2006

(54) BALL WITH RECEPTACLE TO RECEIVE A KEY

(75) Inventors: Clancy G. Boyer, Aloha, OR (US); Richard G. Avis, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/457,900

(22) Filed: Jun. 10, 2003

(51) Int. Cl.
*A63B 43/02* (2006.01)

(52) U.S. Cl. ..... 473/575; 473/596

(58) Field of Classification Search ..... 473/575, 473/576, 596, 423–425, 139
See application file for complete search history.

(56) References Cited

U.S. PATENT DOCUMENTS 653,175 A * 7/1900 Gamble ..... 473/575
830,582 A * 9/1906 Fleischman ..... 473/575
1,421,407 A * 7/1922 Clark ..... 473/576
2,115,926 A * 5/1938 Hatton ..... 473/596
2,226,246 A * 12/1940 Kloepping ..... 473/575
2,500,073 A * 3/1950 Hayes ..... 473/575
3,397,887 A * 8/1968 Caplan ..... 473/575
3,693,972 A * 9/1972 Minchin ..... 473/575
3,804,409 A * 4/1974 Schachner ..... 473/423
4,192,044 A * 3/1980 Ballerini ..... 473/575
4,664,388 A * 5/1987 Huber ..... 473/575
5,054,786 A * 10/1991 Solomon ..... 473/575

* cited by examiner

*Primary Examiner*—Steven Wong
(74) *Attorney, Agent, or Firm*—Banner & Witcoff, Ltd.

(57) ABSTRACT

An inflatable ball capable of being attached to an external device includes an inflatable ball and a receptacle. The receptacle includes a cavity and an opening in communication with the cavity. The cavity and opening are configured to receive a key, which may be releasingly engaged in the receptacle and secured to a strap in order to conveniently carry the ball.

41 Claims, 5 Drawing Sheets

BALL WITH RECEPTACLE TO RECEIVE A KEY

FIELD OF THE INVENTION

This invention relates generally to the field of balls used for athletic activities and, in particular, to such balls that can be easily carried.

BACKGROUND OF THE INVENTION

Balls used for athletic activities, e.g., soccer balls, volleyballs, basketballs, footballs, etc., often need to be carried by individuals to and from the places where they are used. Such balls cannot always be conveniently carried, especially when the individual is carrying other items. For example, students traveling to school may have a backpack filled with books and other materials. Carrying a ball in addition to the backpack and other materials can be problematic. Carrying the ball within the backpack may not be possible, since the backpack may not be large enough to carry such a ball, or may already be filled with books and/or other items. Further, carrying more than one ball at a time can prove difficult if an individual does not a have a bag large enough to hold all of the balls at one time.

It is an object of the present invention to provide a ball that can be carried in a manner that reduces or wholly overcomes some or all of the difficulties inherent in prior known ways of carrying a ball. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, an inflatable ball capable of being attached to an external device includes an inflatable ball, and a receptacle having a cavity formed therein. An opening is in communication with the cavity, and the opening and cavity are configured to receive a key.

In accordance with another aspect, an inflatable ball capable of being carried other than by directly holding the ball includes an inflatable ball and a strap releasably secured at one end to the inflatable ball.

In accordance with yet another aspect, a ball capable of being attached to an external device includes a ball and a receptacle. The receptacle comprises a recess formed in the ball and a cover positioned in the recess. The cover has a cavity formed therein and an opening in communication with the cavity. A key is configured to be at least partially received within the cavity.

In accordance with a further aspect, an assembly to attach a ball to a bag includes a ball and a receptacle. The receptacle includes a recess formed in the ball and a cover for the recess. The cover has a cavity formed therein and an opening in communication with the cavity. A key includes a handle portion, a tab portion, and a neck portion connecting the tab portion to the handle portion. The tab portion is insertable through the opening and into the cavity, and the neck portion is insertable into the opening. The key is releasably engageable with the receptacle when the key is rotated within the cavity after the tab portion is inserted through the opening. A bag that is configured to carry items is connected to the key by a strap.

In accordance with yet another aspect, an assembly for carrying an inflatable ball includes a strap and a key secured to an end of the strap. The key is configured to be releasably secured to an inflatable ball.

Substantial advantage is achieved by providing a ball with a receptacle configured to receive a keyed strap. In particular, an individual can securely and safely carry a ball with such a device. The individual can even carry the ball in a hands-free manner. This is highly advantageous since the individual need not occupy an entire arm to carry a ball, and need not worry about dropping the ball. Additionally, the individual can easily carry more than one ball, as well as carry additional items along with the ball.

These and additional features and advantages of the invention disclosed here will be further understood from the following detailed disclosure of certain preferred embodiments.

Figure 1:
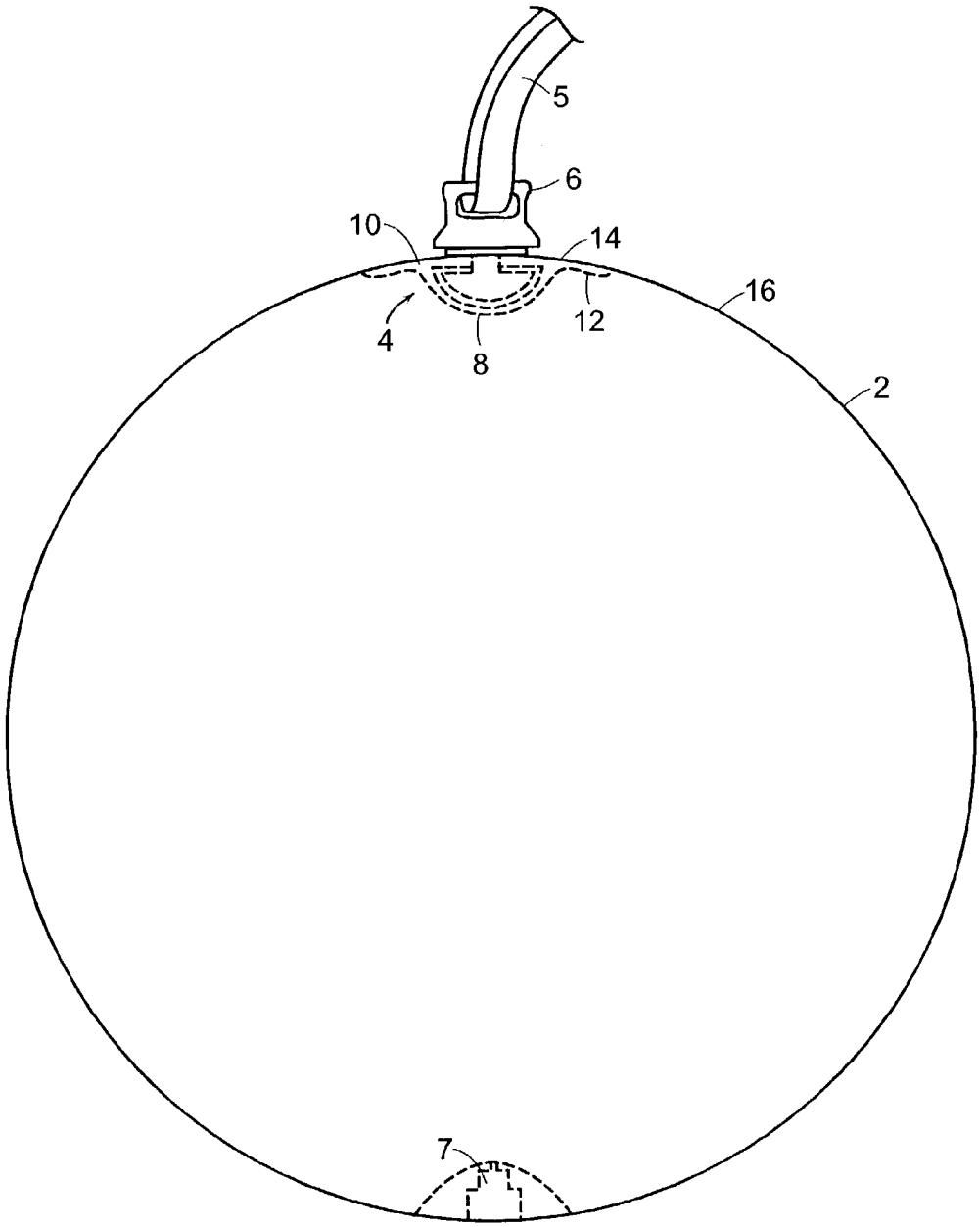
FIG. 1 is an elevation view of a ball in accordance with the present invention, shown with a receptacle secured to the ball, and a key engaged within the receptacle.

The figures referred to above are not drawn necessarily to scale and should be understood to present a representation of the invention, illustrative of the principles involved. Some features of the ball depicted in the drawings have been enlarged or distorted relative to others to facilitate explanation and understanding. The same reference numbers are used in the drawings for similar or identical components and features shown in various alternative embodiments. Balls that can be carried with keyed straps as disclosed herein, will have configurations and components determined, in part, by the intended application and environment in which they are used.

DETAILED DESCRIPTION OF CERTAIN PREFERRED EMBODIMENTS

The present invention may be embodied in various forms. In a preferred embodiment, as illustrated in FIG. 1, a ball 2 has a receptacle 4. Receptacle 4 is configured to receive a key 6. A strap 5 is releasably secured to ball 2 by way of receptacle 4, allowing an individual to carry ball 2 without the need to directly hold the ball itself. Receptacle 4 includes a recess 8 formed in ball 2, and a cover 10 that is seated in recess 8. In a preferred embodiment, recess 8 is substantially dome-shaped, and may have a shoulder 12 formed about its periphery.

A peripheral portion of cover 10 may be seated on shoulder 12 of recess 8 such that an exterior surface 14 of cover 10 is substantially flush with, that is, substantially in the same plane as, exterior surface 16 of ball 2. In certain preferred embodiments, cover 10 is formed of a flexible material, e.g., nylon, rubber, thermopolyurethane, or polyurethane. Cover 12 may be secured to ball 2 by an adhesive, epoxy, or any other suitable fastening means.

Ball 2 may be an inflatable ball, e.g., a soccer ball or volleyball, having an inflation valve 7. In a preferred embodiment, receptacle 4 is positioned opposite, that is, diametric, inflation valve 7.

Figure 2:
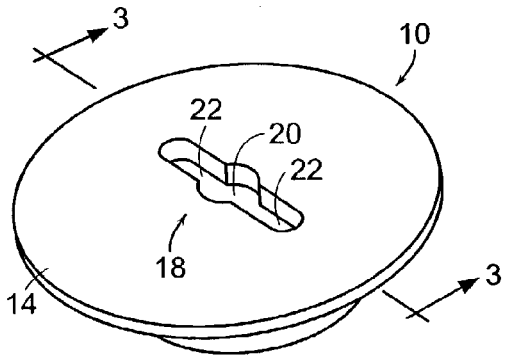
FIG. 2 is a perspective view of the cover of the receptacle of FIG. 1.

As seen in FIG. 2, cover 10 has an opening 18 formed therein. In the illustrated embodiment, opening 18 includes a central circular aperture 20. A pair of slots 22 is formed in cover 10, with the slots 22 positioned on opposite sides of aperture 20 and extending outwardly from circular aperture 20, substantially coaxial with one another.

Figure 3:
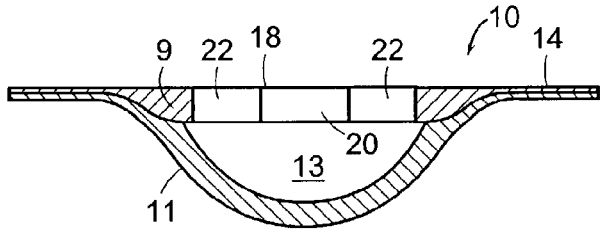
FIG. 3 is a section view of the cover of the receptacle of FIG. 1, taken along line 3—3 of FIG. 2.

In a preferred embodiment, as can be seen in FIG. 3, cover 10 may be formed of a lid 9 and a bowl 11, with a cavity 13 formed between lid 9 and bowl 11. Lid 9 and bowl 11 may be co-molded, or formed separately and subsequently secured to one another, such as with an adhesive, epoxy or other suitable fastening means. It is to be appreciated that cavity 13 may have any shape that is adequately sized and shaped to receive a key 6, and may have a shape that mates closely with the shape of key 6.

Figure 4:
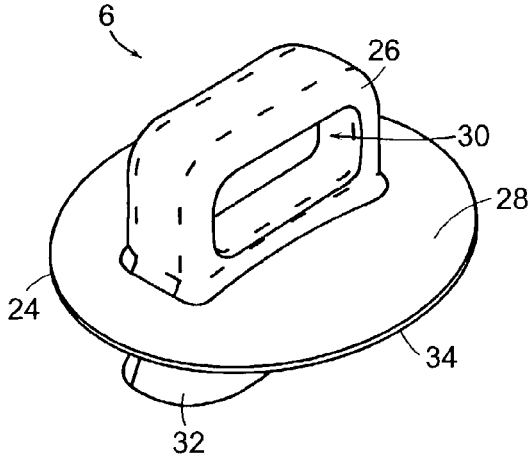
FIG. 4 is a perspective view of the key of the receptacle of FIG. 1, showing a top of the key.
Figure 5:
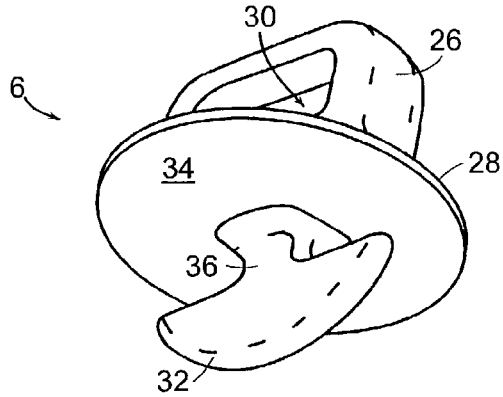
FIG. 5 is a perspective view of the key of the receptacle of FIG. 1, showing a bottom of the key.

A preferred embodiment of key 6 is shown in FIGS. 4–5. Key 6 has a base portion 24, and a handle portion 26 that extends from a first surface 28 of base portion 24. An aperture 30 is formed in key 6. In the illustrated embodiment, aperture 30 is formed in handle portion 26. A tab portion 32 extends from a second surface 34 of base portion 24. In a preferred embodiment, second surface 34 is substantially opposed to first surface 28. That is, first surface 28 is on a side of base portion 24 opposite to that of second surface 34. Tab portion 32 may be connected to second surface 34 by a neck portion 36. In a preferred embodiment, tab portion 32 is substantially planar, with a fan-shaped or dome-shaped profile.

Figure 6:
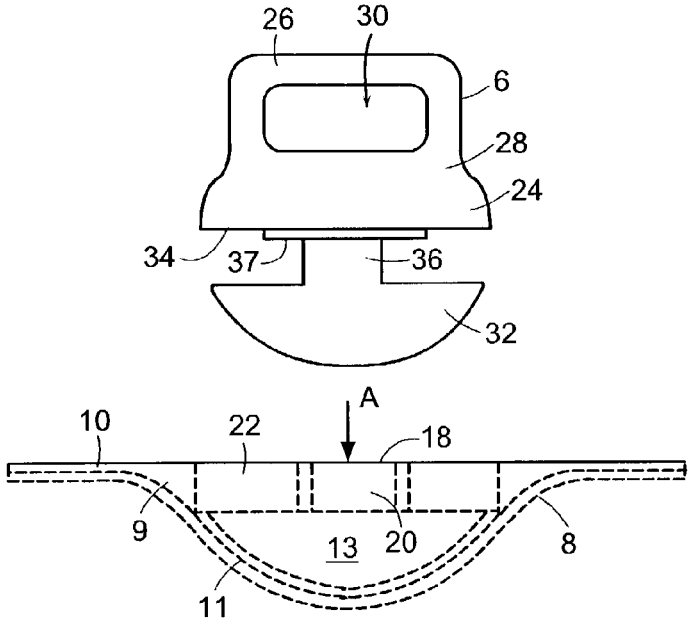
FIG. 6 is a schematic elevation view, shown partially broken away, illustrating the key of FIG. 1 just prior to being inserted into the receptacle.
Figure 7:
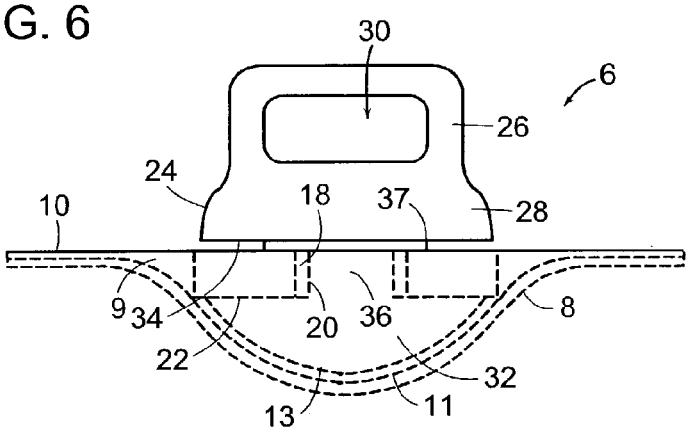
FIG. 7 is a schematic elevation view, shown partially broken away, illustrating the key of FIG. 1 just after being inserted into the receptacle.
Figure 8:
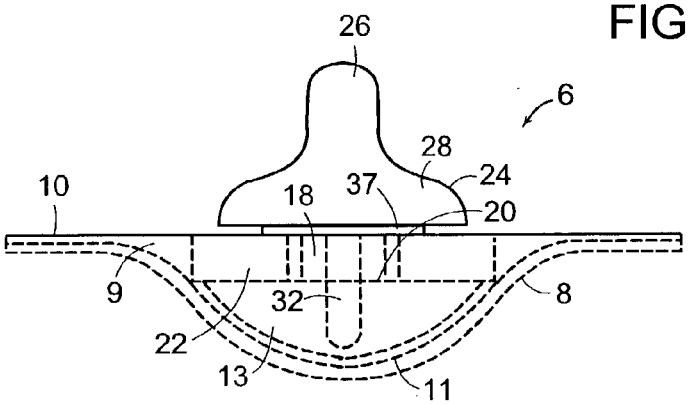
FIG. 8 is a schematic elevation view, shown partially broken away, illustrating the key of FIG. 1 after being rotated within the receptacle.

As can be seen in FIGS. 6–8, a portion of key 6 can be inserted through opening 18 into cavity 13 of cover 10. After being inserted into cavity 13, key 6 can be rotated a predetermined distance, e.g., approximately 90° as illustrated here. In such a position, the inserted portion of key 6 is positioned within cavity 13 beneath lid 9. Thus, key 6 is releasably engaged in receptacle 4. That is, key 6 is temporarily secured within receptacle 4. Key 6 can be removed from receptacle 4 simply by turning key 6 back to its original position and pulling key 6 out through opening 18 to remove the portion that had been inserted into cavity 13.

In the illustrated embodiment, tab portion 32 of key 6 is inserted through circular aperture 20 and slots 22 until it is positioned within cavity 13 and neck portion 36 is positioned in circular aperture 20. Key 6 can then be rotated a predetermined distance, e.g., approximately 90° to the position illustrated in FIG. 8, at which point tab portion 32 of key 6 is positioned beneath lid 9 of cover 10 within cavity 13. Thus, key 6 is releasably engaged in receptacle 4. That is, key 6 is temporarily secured within receptacle 4.

Key 6 may be releasably engaged in receptacle 4 in other ways. For example, key 6 may be configured to be snap-fit directly into a recess or cavity formed in receptacle 4. Alternatively, key 6 could have a threaded portion to threadingly mate with a threaded recess or cavity of receptacle 4. It is to be appreciated that key 6 and receptacle 4 may be configured in many ways that will allow key 6 to be releasably engaged with receptacle 4, allowing a user to temporarily secure key 6 to ball 2.

Key 6 may be formed of plastic (e.g., thermopolyurethane, or nylon), metal, or any other suitable material that can be retained within receptacle 4.

In certain preferred embodiments, a washer 37 is positioned about neck portion 36. Washer 37 may be formed of foam rubber, or any other resilient material. The compressibility of washer 37 serves to accommodate different thicknesses of lid 9 of cover 10, thereby helping ensure that key 6 is retained securely within cavity 13 of receptacle 4. Washer 37 would also serve to accommodate different thicknesses of the casing of ball 2 in embodiments where receptacle 4 is part of ball 2 itself.

Figure 9:
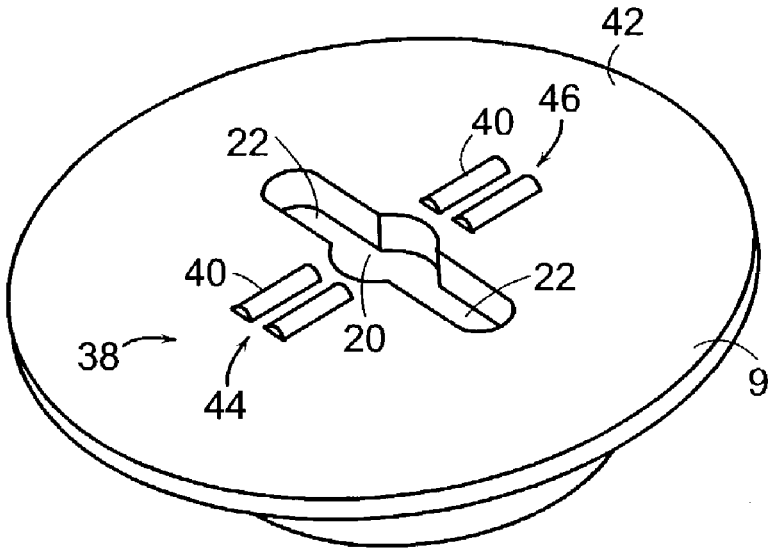
FIG. 9 is a perspective view of an alternative embodiment of the cover of the receptacle of FIG. 1, showing an interior surface of the cover.
Figure 10:
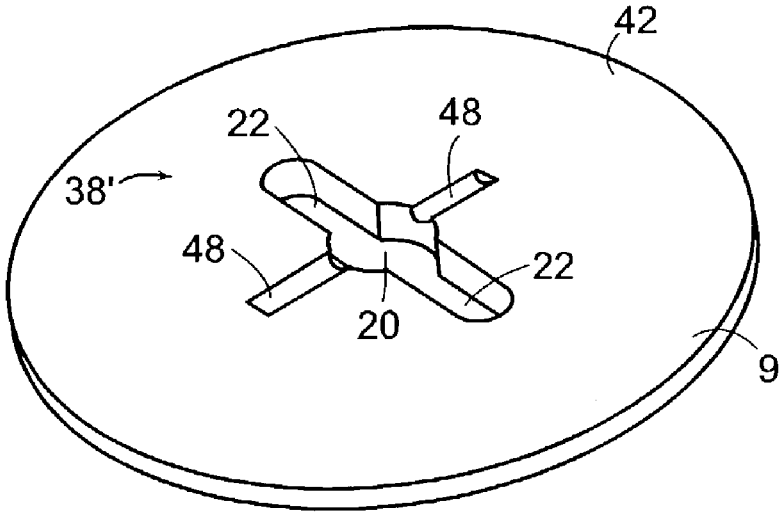
FIG. 10 is a perspective view of another alternative embodiment of the cover of the receptacle of FIG. 1, showing an interior surface of the cover.

In certain preferred embodiments, as seen in FIGS. 9–10, receptacle 4 includes a locking member 38 that helps secure key 6 to receptacle 4 to reduce the chance that key 6 is inadvertently removed from receptacle 4. In the embodiment illustrated in FIG. 9, locking member 38 comprises a plurality of projections 40 formed on an interior surface 42 of lid 9. As seen in the illustrated embodiment, a first pair 44 of projections 40, which are spaced apart from one another, is positioned proximate aperture 20, with another pair 46 of projections 40 spaced apart from one another and positioned proximate aperture 20, opposite first pair 44. When key 6 is rotated into its engaged position, tab portion 32 snaps into an engaged position between the projections 40 of first and second pairs 44, 46, thereby retaining key 6 within receptacle 4. To remove key 6, it is rotated out of its engagement with projections 40 back to its original position such that tab portion 32 is in alignment with opening 18, and then pulled out from opening 18. Thus, it can be seen that locking member 38 allows key 6 to be more positively retained in its engaged position within receptacle 4, reducing the chances of key 6 being knocked free or otherwise inadvertently removed from receptacle 4.

In the embodiment illustrated in FIG. 10, locking member 38' may be a pair of grooves 48 formed on interior surface 42 of lid 9, extending outwardly from opposite sides of aperture 20 and substantially coaxial with one another. In such an embodiment, tab portion 24 may be spaced from second surface 34 a distance that is slightly smaller than the thickness of lid 9 of cover 10. Therefore, once key 6 is been inserted through opening 18 into cavity 13, pressure must be exerted on key 6 to get it to rotate within cavity 13. Key 6 is rotated until tab portion 24 is seated in grooves 48, thereby retaining key 6 within receptacle 4.

It is to be appreciated that other configurations of locking member 38 are possible, and considered to be within the scope of the present invention. For instance, locking members such as the projections and grooves discussed above, or other embodiments of a locking member, could be positioned on the surface of bowl 11 within cavity 13. Suitable configurations for a locking member that will allow key 6 to be releasingly engaged with receptacle 4 will become readily apparent to those skilled in the art, given the benefit of this disclosure.

Figure 11:
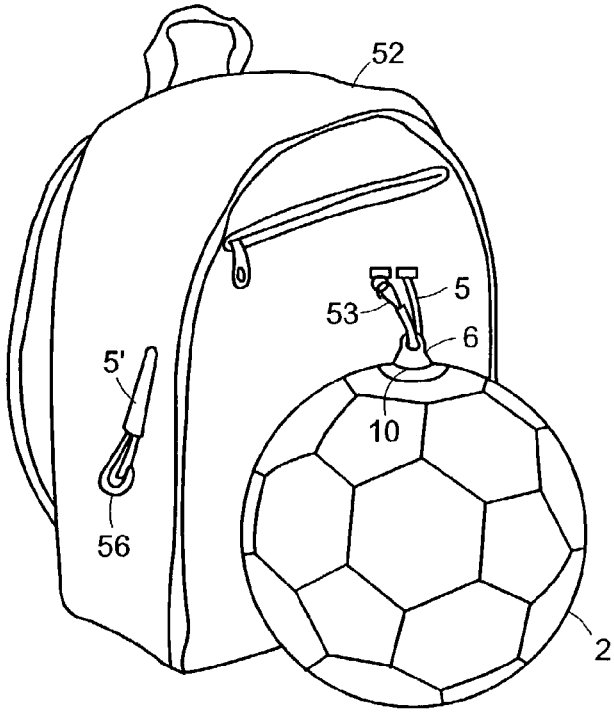
FIG. 11 is a perspective view of a ball in accordance with the present invention, shown with its key secured to a backpack by a strap.

As illustrated in FIG. 11, strap 5 can be secured to key 6, allowing ball 2 to be releasably secured to an external device, such as a bag 52. Strap 5 may be a strip of material, a leash, a cord, a lanyard or any other piece of material that can be secured to key 6. In the illustrated embodiment, strap 5 extends through aperture 30 of key 6. In a preferred embodiment, strap 5 is formed of nylon. Strap 5 may be secured at ends thereof to bag 52. As illustrated here, strap 5 is permanently secured at one end to bag 52 and releasably secured at its other end to bag 52 by way of a releasable clip 53. It is to be appreciated that bag 52 may be a backpack, as illustrated here, a book bag, a duffel bag, a shoulder bag, a garment bag, or any other type of bag to which a strap may be secured in order to carry a ball.

Bag 52 may have a plurality of straps 5 secured thereto, thereby allowing a plurality of balls 2 to be carried with bag 52. In the illustrated embodiment, two straps are shown secured to bag 52. In the embodiment illustrated in FIG. 11, a strap 5' is secured at one end to bag 52, and at its other end to a releasable clip 56. Clip 56 may be snapped on or otherwise releasable secured to handle portion 26.

It is to be appreciated that strap 5 need not be secured to a bag. In certain embodiments, strap 5 could simply be an endless loop of material that extends through aperture 30 in key 6, allowing an individual to carry ball 2 simply by grasping the strap.

Figure 12:
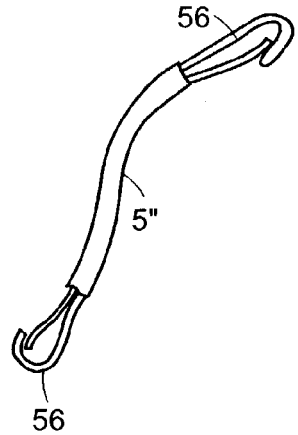
FIG. 12 is a perspective view of an alternative embodiment of a strap that can be secured to the key of the receptacle of FIG. 1.

A strap 5" may have clips 56 on each end, as seen in FIG. 12, allowing strap 5" to be temporarily attached at one end to key 6 and at its other end to a ring or other device on bag 52, or any other member, including, for example, a hook in a locker.

Figure 13:
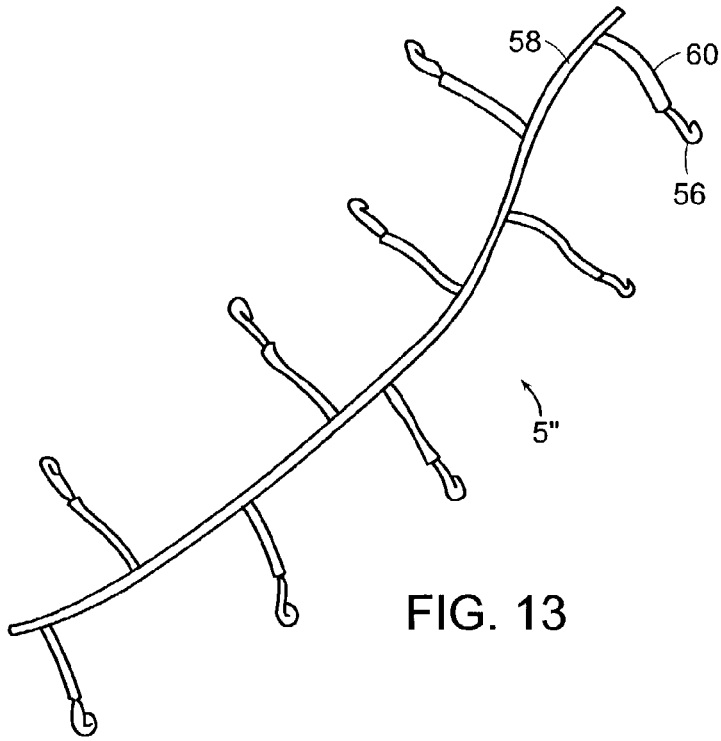
FIG. 13 is a perspective view of another alternative embodiment of a strap that can be secured to the key of the receptacle of FIG. 1.

A strap 5'" may be formed of a central member 58, with a plurality of secondary straps 60 secured to central member 58, as seen in FIG. 13. Each secondary strap 60 may have a clip 56 secured thereto, allowing a plurality of balls 2 to be easily carried together.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

We claim:

1. An inflatable ball capable of being attached to an external device comprising, in combination:
- an inflatable ball; and
- a receptacle comprising:
  - a recess formed in the ball and having a shoulder formed about a periphery thereof; and
  - a cover for the recess, the cover comprising a bowl and a lid substantially covering the entire bowl, the bowl and the lid defining a cavity configured to receive a key, the lid having a single central opening formed therein configured to receive a key, a peripheral portion of the cover being seated on the shoulder such that an exterior surface of the cover is substantially flush with an exterior surface of the ball.

2. The inflatable ball of claim 1, wherein an exterior surface of the cover is substantially flush with an exterior surface of the ball.

3. The inflatable ball of claim 1, wherein an interior surface of the cavity includes a locking member.

4. The inflatable ball of claim 3, wherein the locking member comprises a plurality of projections.

5. The inflatable ball of claim 3, wherein the locking member comprises a first pair of projections spaced apart from one another, and a second pair of projections spaced apart from one another, the first and second pair of projections being on opposite sides of the opening.

6. The inflatable ball of claim 3, wherein the locking member comprises at least one groove.

7. The inflatable ball of claim 1, wherein the opening comprises an aperture and a pair of slots, the slots positioned on opposite sides of the aperture and extending outwardly from the aperture.

8. The inflatable ball of claim 1, wherein the ball includes an inflation valve.

9. The inflatable ball of claim 8, wherein the receptacle is diametric the inflation valve.

10. An inflatable ball capable of being carried other than by directly holding the ball comprising, in combination:
- an inflatable ball;
- a recess formed in the ball and having a shoulder formed about a periphery thereof; and
- a cover for the recess, the cover comprising a bowl and a lid substantially covering the entire bowl, the bowl and the lid defining a cavity configured to receive a key, the lid having a single central opening formed therein configured to receive a key, a peripheral portion of the cover being seated on the shoulder such that an exterior surface of the cover is substantially flush with an exterior surface of the ball; and
- a strap releasably secured at one end to the cover.

11. The inflatable ball of claim 10, wherein an interior surface of the cavity includes a locking member.

12. The inflatable ball of claim 11, wherein the locking member comprises a first pair of projections on an interior surface of the cover and spaced apart from one another, and a second pair of projections on an interior surface of the cover and spaced apart from one another, the first and second pair of projections being on opposite sides of the opening.

13. The inflatable ball of claim 10, wherein the opening comprises an aperture and a pair of slots, the slots positioned on opposite sides of the aperture and extending outwardly from the aperture.

14. The inflatable ball of claim 10, wherein the ball includes an inflation valve.

15. The inflatable ball of claim 14, wherein the strap is secured to the ball at a position diametric the inflation valve.

16. A ball capable of being attached to an external device comprising, in combination:
- a ball;
- a receptacle, the receptacle comprising a recess formed in the ball and having a shoulder formed about a periphery thereof, and a cover positioned in the recess, the cover comprising a bowl and a lid substantially covering the entire bowl, the bowl and the lid defining a cavity, the lid having a single central opening formed therein, a peripheral portion of the cover being seated on the shoulder such that an exterior surface of the cover is substantially flush with an exterior surface of the ball; and
- a key configured to be at least partially received within the cavity.

17. The ball of claim 16, wherein the key is configured to be releasingly engaged with the cover.

18. The ball of claim 16, wherein the key comprises a handle portion, a tab portion, and a neck portion connecting the tab portion to the handle portion.

19. The ball of claim 18, wherein the tab portion has a substantially dome-shaped profile.

20. The ball of claim 18, wherein the tab portion and neck portion are configured to be insertable into the opening such that the key is releasably engaged within the cavity when the key is rotated after the tab portion and neck portion are inserted into the opening.

21. The ball of claim 18, further comprising a resilient washer positioned about the neck portion.

22. The ball of claim 16, wherein the opening comprises an aperture and a pair of slots, the slots positioned on opposite sides of the aperture and extending outwardly from the aperture.

23. The ball of claim 22, wherein the key comprises a handle portion, a tab portion, and a neck portion connecting the tab portion to the handle portion, the tab portion being configured to be insertable through the slots and the circular aperture into the cavity and the neck portion is configured to be insertable into the circular aperture, such that when the tab portion is rotated after being inserted into the opening, the neck portion rotates within the circular aperture and the tab portion rotates within the cavity.

24. The ball of claim 23, wherein a strap is secured to the handle portion by way of an aperture extending through the key.

25. The ball of claim 16, further comprising a strap secured to the key.

26. The ball of claim 25, further comprising a releasable clip secured to at least one end of the strap.

27. The ball of claim 25, further comprising an aperture in the key, the strap extending through the aperture.

28. The ball of claim 16, wherein the key comprises a substantially planar base portion, a handle portion extending from the base portion and having an aperture therein, a tab portion, and a neck portion connecting the tab portion to the base portion.

29. The ball of claim 16, wherein the recess is substantially dome-shaped.

30. The ball of claim 16, further including a locking member on an interior surface of the cavity.

31. The ball of claim 30, wherein the locking member comprises a first pair of projections positioned on an interior surface of the cover and spaced apart from one another, and a second pair of projections positioned on an interior surface of the cover and spaced apart from one another, the first and second pair of projections being on opposite sides of the opening.

32. An assembly to attach a ball to a bag comprising, in combination:

a ball;

a receptacle, the receptacle comprising a recess formed in the ball and a cover for the recess, the cover comprising a bowl and a lid substantially covering the bowl, the bowl and the lid defining a cavity, the lid having a central opening formed therein;

a key comprising a handle portion, a tab portion, and a neck portion connecting the tab portion to the handle portion, the tab portion being insertable through the opening and into the cavity and the neck portion being insertable into the opening, the key being releasably engageable with the receptacle when the key is rotated within the cavity after the tab portion is inserted through the opening;

a bag configured to carry items; and a strap connecting the key to the bag.

33. The assembly of claim 32, further comprising:

an additional key comprising a handle portion, a tab portion, and a neck portion connecting the tab portion to the handle portion; and an additional strap securing the additional key to the bag.

34. The assembly of claim 32, further comprising at least one additional strap configured to be secured to the bag.

35. The assembly of claim 32, further comprising a resilient washer positioned about the neck portion.

36. An assembly for carrying an inflatable ball comprising, in combination:

a ball;

a receptacle comprising a recess formed in the ball and having a shoulder formed about a periphery thereof and a cover positioned in the recess, the cover comprising a bowl and a lid substantially covering the entire bowl, the bowl and the lid defining a cavity, the lid having a single central opening formed therein, a peripheral portion of the cover being seated on the shoulder such that an exterior surface of the cover is substantially flush with an exterior surface of the ball;

a key configured to be releasably secured to the lid;

a strap secured at an end thereof to the key.

37. The assembly of claim 36, further comprising an aperture formed in the key.

38. The assembly of claim 37, wherein the strap extends through the aperture.

39. The assembly of claim 36, wherein the key comprises a handle portion and a tab portion, the strap secured to the handle portion and the tab portion configured to be releasably secured to the lid.

40. The assembly of claim 39, further comprising a neck portion connecting the tab portion to the handle portion.

41. The assembly of claim 40, further comprising a resilient washer positioned about the neck portion.

* * * * *